US008977151B2

(12) United States Patent
Furukawa

(10) Patent No.: US 8,977,151 B2
(45) **Date of Patent: *Mar. 10, 2015**

(54) IMAGE FORMING APPARATUS

(75) Inventor: Kunio Furukawa, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 92 days.

This patent is subject to a terminal disclaimer.

(21) Appl. No.: 13/564,404

(22) Filed: Aug. 1, 2012

(65) Prior Publication Data

US 2013/0034360 A1 Feb. 7, 2013

(30) Foreign Application Priority Data

Aug. 4, 2011 (JP) ..... 2011-170879

(51) Int. Cl.

| | |
|---|---|
| ***G03G 15/06*** | (2006.01) |
| *G03G 15/09* | (2006.01) |
| *G03G 15/08* | (2006.01) |
| *G03G 15/00* | (2006.01) |

(52) U.S. Cl.

CPC ..... *G03G 15/065* (2013.01); *G03G 15/0907* (2013.01); *G03G 15/0813* (2013.01); *G03G 15/80* (2013.01); *G03G 2215/0132* (2013.01)

USPC ..... 399/55; 399/285

(58) Field of Classification Search

CPC ..... G03G 15/0115; G03G 15/065; G03G 15/0907

USPC ..... 399/55, 285

See application file for complete search history.

(56) References Cited

U.S. PATENT DOCUMENTS

| | | | | |
|---|---|---|---|---|
| 5,946,523 | A * | 8/1999 | Fujioka et al. | 399/49 |
| 5,950,042 | A * | 9/1999 | Goto et al. | 399/53 |
| 2008/0232863 | A1 | 9/2008 | Saiki | |
| 2013/0028621 | A1 * | 1/2013 | Furukawa | 399/55 |

FOREIGN PATENT DOCUMENTS

| | | | |
|---|---|---|---|
| JP | 07-325468 | A | 12/1995 |
| JP | 08-156330 | A | 6/1996 |
| JP | 2008-233489 | A | 10/2008 |

* cited by examiner

*Primary Examiner* — Benjamin Schmitt

(74) *Attorney, Agent, or Firm* — Buchanan Ingersoll & Rooney PC

(57) ABSTRACT

An image forming apparatus having; a latent image support member; a latent image forming unit for forming an electrostatic latent image on the latent image support member; a developer support member for supplying toner to the latent image support member to develop the electrostatic latent image; a voltage applying device for applying a developing bias, which is a superimposed voltage of a DC voltage and an AC voltage, to the developer support member; a first selecting device for selecting a screen ruling; and a second selecting device for selecting a frequency of the AC voltage. The second selecting device selects a first frequency when the first selecting device selects a first screen ruling, and selects a second frequency lower than the first frequency when the first selecting device selects a second screen ruling higher than the first screen ruling.

4 Claims, 6 Drawing Sheets

IMAGE FORMING APPARATUS

This application is based on Japanese Patent Application No. 2011-170879 filed on Aug. 4, 2011, the content of which is incorporated herein by reference.

BACKGROUND OF THE INVENTION

1. Filed of the Invention

The present invention relates to an image forming apparatus, particularly to an image forming apparatus that develops an electrostatic latent image with toner.

2. Description of Related Art

In a conventional image forming apparatus, a developing roller supports a developer composed of magnetic carriers and non-magnetic toner, and supplies the non-magnetic toner to a photosensitive drum with an electrostatic latent image formed thereon so as to develop the electrostatic latent image. In the image forming apparatus, a developing bias is applied to the developing roller so as to form an electric field for movement of the toner from the developing roller to the photosensitive drum.

With respect to the developing bias application, there are two methods, namely, a DC application method and an AC application method. In the DC application method, a DC voltage is applied as the developing bias, and in the AC application method, a superimposed voltage of a DC voltage and an AC voltage is applied as the developing bias. The AC application method permits more faithful development of the electrostatic latent image on the photosensitive drum than the DC application method. Accordingly, an even and smooth toner image (a toner image with favorable graininess) can be formed by the AC application method.

FIG. 5 is a graph showing the AC application method, the relationship between the frequency of the AC developing bias voltage and the graininess. The x-axis shows the frequency of the AC developing bias voltage, and the y-axis shows the graininess. The graininess represents unevenness of a toner image. High graininess means that the toner image has unevenness. FIG. 5 shows cases wherein halftone patches with screen ruling of 210 lpi were formed. The screen ruling represents the halftone dot fineness (how many dots are in a square inch) and is measured in lines per inch (lpi).

As is apparent from FIG. 5, as the frequency of the AC developing bias voltage becomes higher, the graininess becomes lower, and the picture quality of the toner image becomes higher. Therefore, in terms of graininess, it is preferred that the frequency of the AC developing bias voltage is high. More specifically, by setting the frequency of the AC developing bias voltage to 5 kHz or higher, unevenness in a visible degree can be prevented.

FIG. 6 is a graph showing the relationship between the frequency of the AC developing bias voltage and the edge density. The x-axis shows the frequency of the AC developing bias voltage, and the y-axis shows the edge density. The edge density means the toner density at an edge of a toner image in the main-scanning direction. A high edge density means that the toner image has a large difference in toner density between the edge portions in the main-scanning direction and the center portion in the main-scanning direction. (The difference in toner density between the edge portions in the main-scanning direction and the center portion in the main-scanning direction will be hereinafter referred to as a density difference.) Accordingly, when the edge density is high, the picture quality of the toner image is low. FIG. 6 shows cases wherein halftone patches with screen ruling of 210 lpi were formed.

As is apparent from FIG. 6, as the frequency of the AC developing bias voltage becomes lower, the edge density becomes lower, that is, the density difference becomes smaller, and accordingly, the picture quality of the toner image becomes higher. Therefore, in view of a density difference, it is preferred that the frequency of the AC developing bias voltage is low. More specifically, by setting the frequency of the AC developing bias voltage to 5 kHz or lower, a visible density difference can be prevented.

In terms of both the graininess and the density difference, as described above, the frequency of the AC developing bias voltage is preferably 5 kHz.

In conventional image forming apparatuses, generally, the screen ruling is set, depending on the kind of an image to be printed, such as a character image, a photo image or the like. Specifically, when a character image is to be printed, it is necessary to lay weight on reproduction of sharp edges of characters, and therefore, the screen ruling is set high. On the other hand, when a photo image is to be printed, it is necessary to lay weight on smooth gradation expression, and therefore, the screen ruling is set low. In conventional image forming apparatuses, when the screen ruling is changed, it is difficult to keep both the graininess and the density difference in favorable degrees.

FIG. 7 is a graph showing the relationship between the frequency of the AC developing bias voltage and the graininess. The x-axis shows the frequency of the AC developing bias voltage, and the y-axis shows the graininess. FIG. 8 is a graph showing the relationship between the frequency of the AC developing bias voltage and the edge density. The x-axis shows the frequency of the AC developing bias voltage, and the y-axis shows the edge density. FIGS. 7 and 8 show cases where halftone patches with screen ruling of 190 lpi were formed and cases where halftone patches with screen ruling of 210 lpi were formed.

As is apparent from FIG. 7, when a toner image is formed under the conditions that the screen ruling is 190 lpi and that the frequency of the AC developing bias voltage is 5 kHz, the graininess is high, and unevenness is observed in the toner image. In order to avoid this trouble, when the screen ruling 190 lpi, the frequency of the AC developing bias voltage shall be set to 8 kHz or higher.

As is apparent from FIG. 8, when a toner image is formed under the conditions that the screen ruling is 210 lpi and that the frequency of the AC developing bias voltage is 8 kHz, a density difference is observed in the toner image.

As described above, in conventional image forming apparatuses, it is difficult to control both the graininess and the density difference.

As a conventional image forming apparatus, for example, an image forming apparatus disclosed by Japanese Patent Laid-Open Publication No. 7-325468 is known. The image forming apparatus changes the frequency of the developing AC bias voltage in accordance with the resolution and the screen ruling so as to perform stable image formation less affected by environmental changes and the usage history. Specifically, in the image forming apparatus, when the screen ruling is high, the frequency of the AC developing bias voltage is set high, and when the screen ruling is low, the frequency of the AC developing bias voltage is low. Therefore, the image forming apparatus disclosed by Japanese Patent Laid-Open Publication No. 7-325468 cannot control both the graininess and the density difference.

SUMMARY OF THE INVENTION

According to a first aspect of the present invention, an image forming apparatus comprises: a latent image support member; a latent image forming unit for forming an electrostatic latent image on the latent image support member in accordance with image data; a developer support member for supporting a developer including toner and for supplying the toner to the latent image support member to develop the electrostatic latent image; a voltage applying device for applying a developing bias, which is a superimposed voltage of a DC voltage and an AC voltage, to the developer support member; a first selecting device for selecting a screen ruling in accordance with the image data; and a second selecting device for selecting a frequency of the AC voltage, wherein the second selecting device selects a first frequency when the first selecting device selects a first screen ruling, and selects a second frequency lower than the first frequency when the first selecting device selects a second screen ruling higher than the first screen ruling.

According to a second aspect of the present invention, an image forming method comprises the steps of: forming an electrostatic latent image on a latent image support member in accordance with image data; supplying toner from a developer support member to the latent image support member to develop the electrostatic latent image; applying a developing bias, which is a superimposed voltage of a DC voltage and an AC voltage, to the developer support member; selecting a screen ruling in accordance with the image data; and selecting a frequency of the AC voltage, wherein a first frequency is selected when a first screen ruling is selected, and a second frequency lower than the first frequency is selected when a second screen ruling higher than the first screen ruling is selected.

BRIEF DESCRIPTION OF THE DRAWINGS

These and other features of the present invention will be apparent from the following description with reference to the accompanying drawings, in which.

DETAILED DESCRIPTION OF THE PREFERRED EMBODIMENTS

An image forming apparatus according to an embodiment of the present invention will be hereinafter described.

Structure of the Image Forming Apparatus

Figure 1:
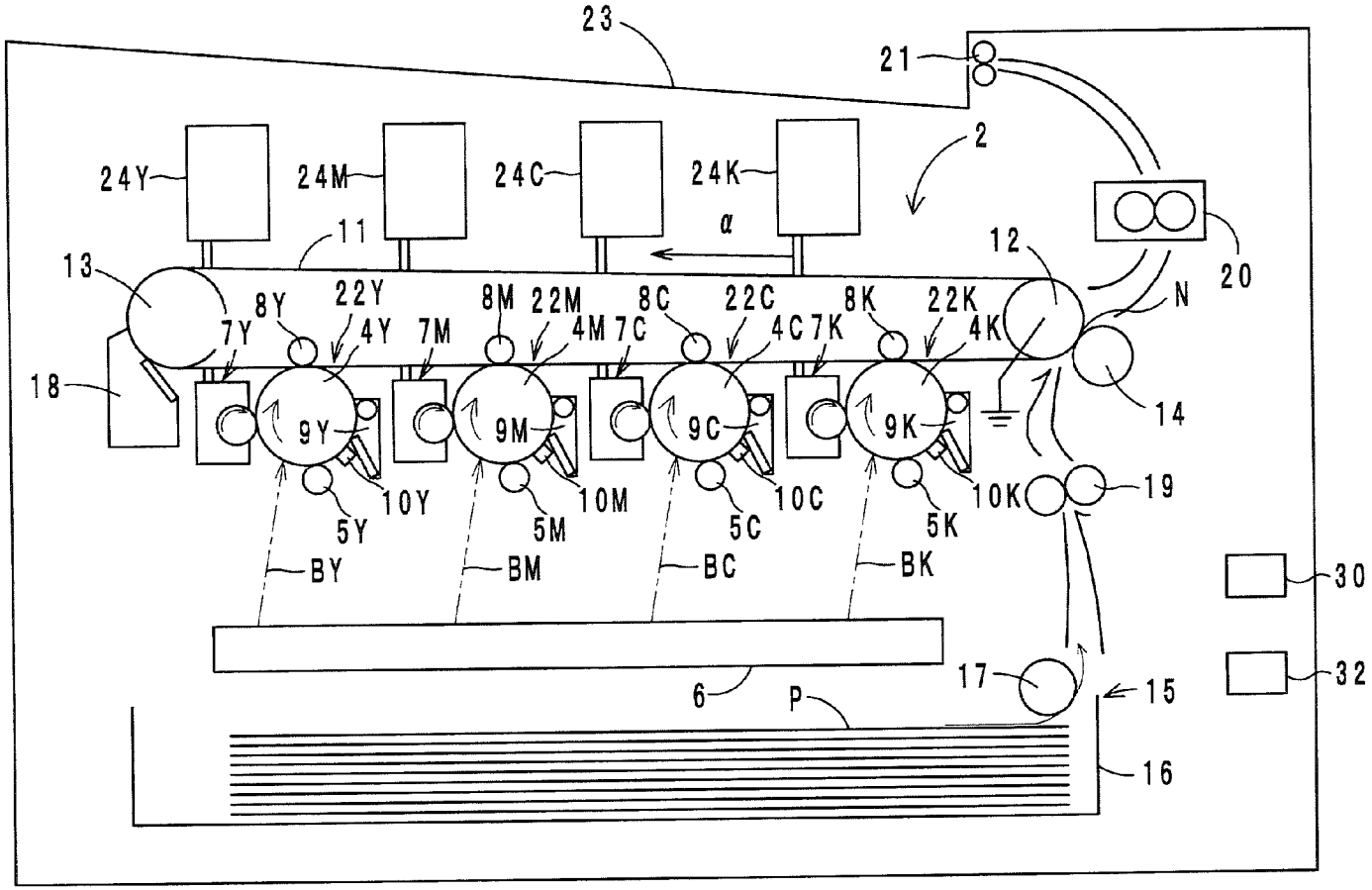
FIG. 1 is a skeleton framework of an image forming apparatus.

The structure of an image forming apparatus according to an embodiment of the present invention will be described with reference to the drawings. FIG. 1 shows the overall structure of the image forming apparatus 1.

The image forming apparatus 1 is an electrophotographic color printer, and forms and combines images of four colors, namely, yellow (Y), magenta (M), cyan (C) and black (K) by a tandem method. The image forming apparatus 1 forms a toner image on a sheet of a print medium P in accordance with image data read with a scanner. As shown in FIG. 1, the image forming apparatus 1 comprises a printing section 2, a feeding section 15, a pair of timing rollers 19, a fixing device 20, a pair of ejection rollers 21, a printed-sheet tray 23, a control unit 30 and a voltage applying device 32.

The control unit 30 is to control the whole image forming apparatus 1, and the control unit 30 is, for example, a CPU. The control unit 30 also functions as a first selecting device for selecting a screen ruling depending on the kind of image data inputted thereto. Specifically, the control unit 30 selects a high screen ruling (for example, 210 lpi) for character data and selects a low screen ruling (for example, 190 lpi) for photo data. The control unit 30 may be configured to recognize the kind of image data by analyzing the image read with the scanner or to recognize the kind of image data based on the print mode set by a user.

The feeding section 15 feeds sheets P one by one, and the feeding section 15 comprises a sheet tray 16 and a feed roller 17. In the sheet tray 16, sheets P to be subjected to printing are stacked. The feed roller 17 picks one from the stack of sheets and feeds the sheet P out of the tray 16. The pair of timing rollers 19 feeds the sheet P in synchronized timing so that a toner image can be transferred onto the sheet P at the printing section 2.

The printing section 2 forms a toner image on the sheet P fed from the feeding section 15. The printing section 2 comprises an optical scanning device 6, transfer devices 8 (8Y, 8M, 8C, 8K), an intermediate transfer belt 11, a driving roller 12, a driven roller 13, a secondary transfer roller 14, a cleaning device 18, image forming units 22 (22Y, 22M, 22C, 22K) and toner bottles 24 (24Y, 24M, 24C, 24K). Each of the image forming units 22 (22Y, 22M, 22C, 22K) comprises a photosensitive drum 4 (4Y, 4M, 4C, 4K), a charger 5 (5Y, 5M, 5C, 5K), a developing device 7 (7Y, 7M, 7C, 7K), a cleaner 9 (9Y, 9M, 9C, 9K) and an eraser 10 (10Y, 10M, 10C, 10K).

Each of the photosensitive drums 4 is cylindrical, and as shown in FIG. 1, rotates clockwise. Each of the photosensitive drums 4 functions as an electrostatic latent image support member that supports an electrostatic latent image on its peripheral surface. Each of the chargers 5 charges the peripheral surface of the corresponding photosensitive drum 4 to a negative potential. The optical scanning device 6 is controlled by the control unit 30 to scan the peripheral surfaces of the photosensitive drums 4 with respective beams BY, BM, BC and BK. In this moment, the control unit 30 controls the performance of the optical scanning device 6 based on the selected screen ruling. The potentials of the portions scanned with the beams BY, BM, BC and BK become almost 0V. Accordingly, an electrostatic latent image is formed on each of the photosensitive drums 4. Thus, the optical scanning device 6, in cooperation with the control unit 30, functions as an electrostatic latent image forming device for forming an electrostatic latent image on each of the photosensitive drums 4 in accordance with image data.

Figure 2:
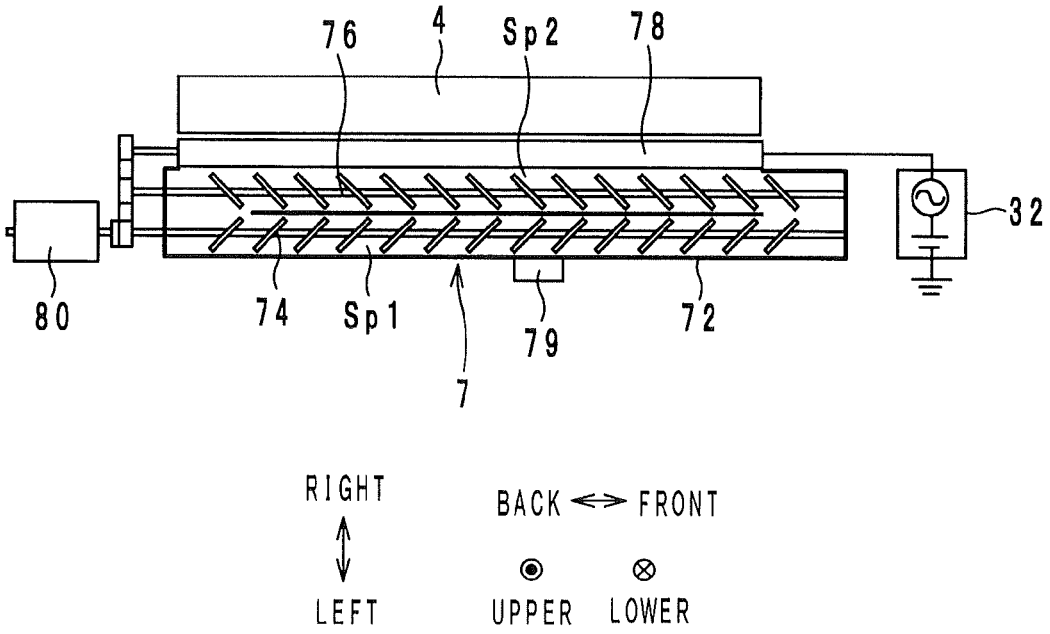
FIG. 2 is a transparent view of a developing device, viewed from above.

Each of the developing devices 7 develops the electrostatic latent image on the corresponding photosensitive drum 4 into a toner image with a two-component developer composed of non-magnetic toner and magnetic carriers. The developing devices 7 will be described below referring to the drawings. FIG. 2 is a transparent view of one of the developing devices 7, viewed from above. The vertical direction on the paper of FIG. 2 is the lateral (right-left) direction of the image forming apparatus 1, and the lateral direction on the paper of FIG. 2 is the longitudinal (front-back) direction of the image forming apparatus 1. The direction perpendicular to the paper surface of FIG. 2 is the vertical (upper-lower) direction of the image forming apparatus 1. In the following paragraphs, the vertical direction on the paper of FIG. 2 is referred to merely as the lateral (right-left) direction, the lateral direction on the paper of FIG. 2 is referred to merely as the longitudinal (front-back) direction, and the direction perpendicular to the paper surface of FIG. 2 is referred to merely as the vertical (upper-lower) direction.

Each of the developing devices 7, as shown by FIG. 2, comprises a body 72, a stirring screw 74, a supply screw 76, a developing roller 78, a sensor 79 and a motor 80.

The body 72 is a case wherein a developer, the stirring screw 74, the supply screw 76 and the developing roller 78 are set. The body 72 extends in the longitudinal direction and incorporates a stirring space Sp1 and a supply space Sp2 that are adjacent to each other in the lateral direction. The stirring space Sp1 is formed in the left side of the body 72 from the supply space Sp2. The stirring space Sp1 and the supply space Sp2 lead to each other at both ends in the longitudinal direction.

The stirring screw 74 is provided in the stirring space Sp1 and extends in the longitudinal direction. The stirring screw 74 is rotated, thereby feeding the developer from rear to front while stirring the developer. Thereby, the toner is charged negative, and the carriers are charged positive. The developer fed by the stirring screw 74 flows into the supply space Sp2 through the front end of the stirring space Sp1.

The supply screw 76 is provided in the supply space Sp2 and extends in the longitudinal direction. The supply screw 76 is rotated, thereby feeding the developer from front to rear. The developer fed by the supply screw 76 flows into the stirring space Sp 1 through the rear end of the supply space Sp2. Hence, the developer circulates in the stirring space Sp1 and the supply space Sp2.

The developing roller 78 is provided in the supply space Sp2 and extends in the longitudinal direction. The developing roller 78 is opposed to the supply screw 76. The developing roller 78 protrudes from the body 72 and is opposed to the corresponding photosensitive drum 4. The developing roller 78 incorporates a magnet and attracts the magnetic carriers together with the non-magnetic toner by the magnetic force. In this way, the developing roller 78 supports the developer fed by the supply screw 76.

The sensor 79 is fitted to the body 72. The sensor 79 is a magnetic sensor that detects the toner concentration of the developer, which represents the ratio of the non-magnetic toner to the magnetic carriers, by detecting the magnetic permeability of the developer. When the toner concentration detected by the sensor 79 is lower than a predetermined reference value, the control unit 30 makes the toner bottle 24 replenish the body 72 with toner.

The developing roller 78 supplies toner to the photosensitive drum 4 so as to develop the electrostatic latent image on the photosensitive drum 4 into a visible image. The development is described below. The voltage applying device 32 applies a developing bias, which is a superimposed voltage of a DC voltage and an AC voltage, to the developing roller 78. With the application of the developing bias, the potential on the peripheral surface of the developing roller 78 becomes lower than the potentials on the portions of the photosensitive drum 4 that were irradiated with the beam BY, BM, BC or BK (about 0V) and higher than the potentials on the portions that were not irradiated with the beam BY, BM, BC or BK. Since the non-magnetic toner of the developer supported by the developing roller 78 is negatively charged, the toner adheres to the portions of the photosensitive drum 4 that were irradiated with the beam BY, BM, BC or BK. Hence, a toner image with a negative potential is formed on the peripheral surface of each of the photosensitive drums 4.

The motor 80 rotates the stirring screw 74, the supply screw 76 and the developing roller 78.

The intermediate transfer belt 11 is stretched between the driving roller 12 and the driven roller 13. Toner images formed on the respective photosensitive drums 4 are transferred to the intermediate transfer belt 11 and combined with each other into a composite image (primary transfer).

The transfer devices 8 are located in positions to face the inner peripheral surface of the intermediate transfer belt 11. A primary transfer voltage is applied to the transfer devices 8 so that the toner images on the respective photosensitive drums 4 will be transferred to the intermediate transfer belt 11. Thus, the transfer devices 8Y, 8M, 8C and 8K, and the image forming units 22Y, 22M, 22C and 22K function as toner image forming sections for forming toner images of the respective colors on the intermediate transfer belt 11. The cleaners 9 collect residual toner from the peripheral surfaces of the photosensitive drums 4 after the primary transfer. The erasers 10 eliminate the charges from the peripheral surfaces of the photosensitive drums 4. The driving roller 12 is rotated by an intermediate transfer belt driving section (not shown), thereby driving the intermediate transfer belt 11 in a direction shown by arrow a. Thereby, the intermediate transfer belt 11 conveys the composite toner image to the secondary transfer roller 14.

The secondary transfer roller 14, which is cylindrical, is in contact with the intermediate transfer belt 11. In the following paragraphs, the area between the intermediate transfer belt 11 and the secondary transfer roller 14 will be referred to as a nip portion N. A positive bias voltage is applied to the secondary transfer roller 14, and thereby, the secondary transfer roller 14 transfers the toner image supported by the intermediate transfer belt 11 to a sheet P passing through the nip portion N (secondary transfer). More specifically, the driving roller 12 keeps the grounding potential, and the intermediate transfer belt 11, which is in contact with the driving roller 12, keeps a positive potential near the grounding potential. A positive bias voltage is applied to the secondary transfer roller 14 so that the potential of the secondary transfer roller 14 will be higher than the potential of the driving roller 12 and the potential of the intermediate transfer belt 11. Since the toner image is charged negative, the toner image is transferred from the intermediate transfer belt 11 to the sheet P by the effect of an electric field generated between the driving roller 12 and the secondary transfer roller 14.

The cleaning device 18 has a blade that is in contact with the intermediate transfer belt 11, and after the secondary transfer of the toner image to the sheet P, the cleaning device 18 removes residual toner from the intermediate transfer belt 11.

The sheet P with a toner image transferred thereon is fed to the fixing device 20. In the fixing device 20, the sheet P is subjected to a heating treatment and a pressure treatment, whereby the toner image is fixed on the sheet P. The pair of ejection rollers 21 ejects the sheet P to the printed-sheet tray 23. On the printed sheet tray 23, printed sheets P are stacked.

In the image forming apparatus 1 of the structure above, the control unit 30 also functions as a second selecting device for selecting the frequency of the AC developing bias voltage. As the screen ruling is set higher, the number of reproducible tone rows becomes smaller, and the resolution becomes higher. Therefore, when the image data is character data, the control unit 30 selects a high screen ruling (for example, 210 lpi) to achieve a high resolution. On the other hand, when the image data are photo data, the control unit 30 selects a low screen ruling (for example, 190 lpi) to permit more tone rows.

Figure 7:
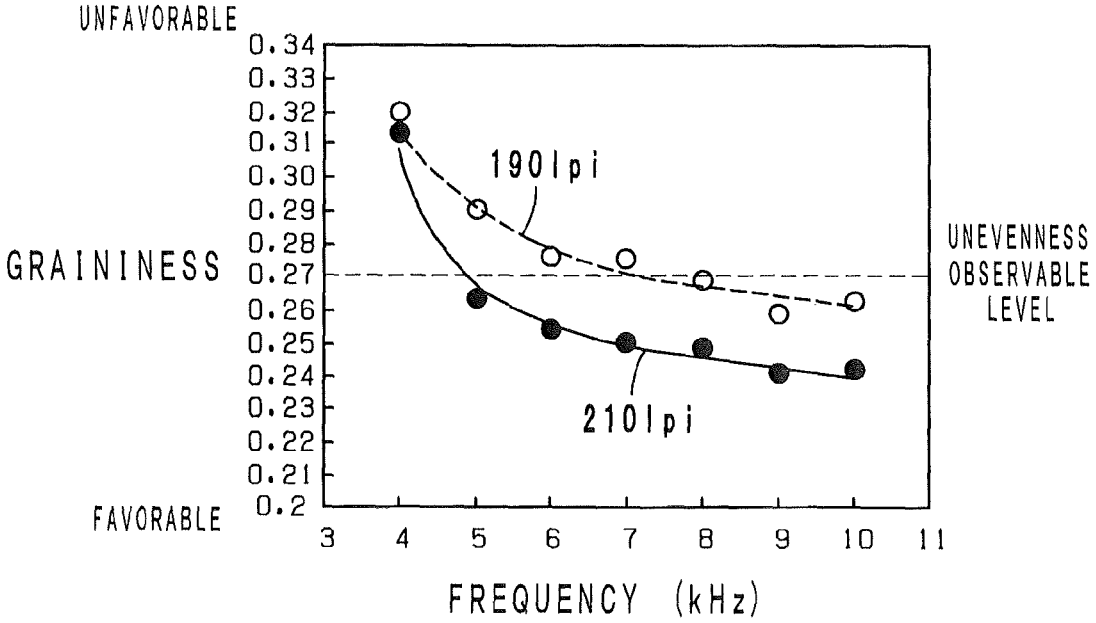
FIG. 7 is a graph showing the relationship between the frequency of an AC developing bias voltage and the graininess.
Figure 8:
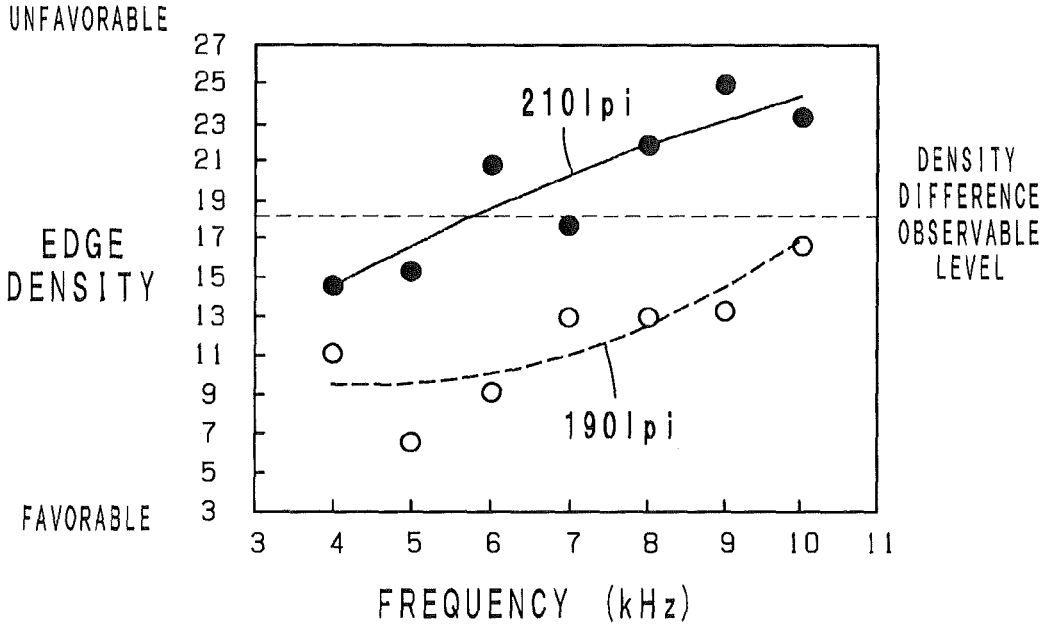
FIG. 8 is a graph showing the relationship between the frequency of an AC developing bias voltage and the edge density.

However, when the screen ruling is changed, it is difficult to keep both the graininess and the density difference in favorable degrees. Table 1 was prepared based on the graph of FIG. 7 to show the relationship among the frequency of the AC developing bias voltage, the screen ruling and the graininess. Table 2 was prepared based on the graph of FIG. 8 to show the relationship among the frequency of the AC developing bias voltage, the screen ruling and the density difference.

TABLE 1

| | 5 kHz | 7 kHZ | 9 kHz |
|---|---|---|---|
| 210lpi | Unevenness Not Observed | Unevenness Not Observed | Unevenness Not Observed |
| 190lpi | Unevenness Observed | Unevenness Observed | Unevenness Not Observed |

TABLE 2

| | 5 kHz | 7 kHZ | 9 kHz |
|---|---|---|---|
| 210lpi | Density Difference Not Observed | Density Difference Observed | Density Difference Observed |
| 190lpi | Density Difference Not Observed | Density Difference Not Observed | Density Difference Not Observed |

As shown in Table 1, as long as the screen ruling is 210 lpi, when the frequency of the AC developing bias voltage is set to any value within the range of 5 kHz to 9 kHz, unevenness is not observed, and the graininess is kept sufficiently low. On the other hand, when the screen ruling is 190 lpi and when the frequency of the AC developing bias voltage is set within the range of 5 kHz to 7 kHz, unevenness is observed, and the graininess cannot be kept low. Thus, in order to keep the graininess sufficiently low, the frequency of the AC developing bias voltage shall be set relatively high when the screen ruling is relatively low.

As shown in Table 2, as long as the screen ruling is 190 lpi, when the frequency of the AC developing bias voltage is set to any value within the range of 5 kHz to 9 kHz, there occurs no density difference. On the other hand, when the screen ruling is 210 lpi and when the frequency of the AC developing bias voltage is set within the range of 7 kHz to 9 kHz, a density difference is observed. Thus, in order to keep the density difference sufficiently low, the frequency of the AC developing bias voltage shall be set relatively low when the screen ruling is relatively high.

For the reasons described above, in the image forming apparatus 1, the control unit 30 selects a relatively high frequency (for example, 9 kHz) as the frequency of the AC developing bias voltage when selecting a relatively low screen ruling (for example, 190 lpi), and selects a relatively low frequency (for example, 5 kHz) as the frequency of the AC developing bias voltage when selecting a relatively high screen ruling (for example, 210 lpi). In this way, in the image forming apparatus 1, both the graininess and the density difference can be kept sufficiently low.

Operation of the Image Forming Apparatus

Figure 3:
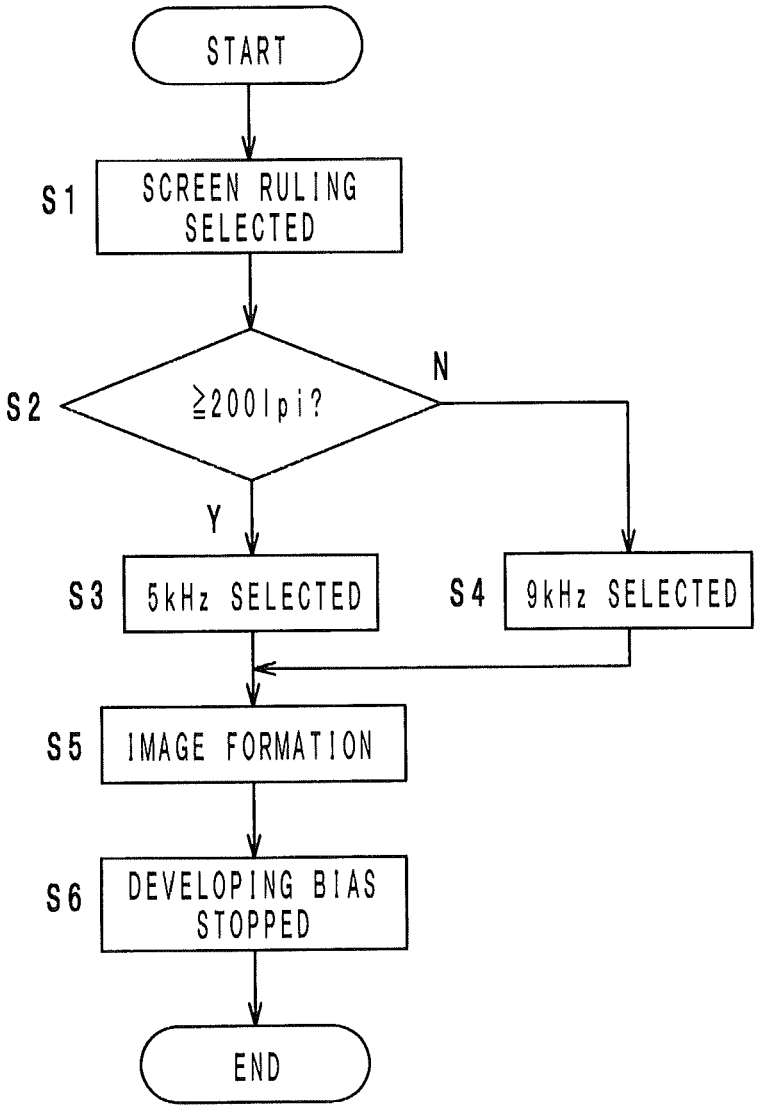
FIG. 3 is a flowchart showing procedures carried out by a control unit of the image forming apparatus for forming a toner image.

Next, the operation of the image forming apparatus 1 will be described. FIG. 3 is a flowchart showing procedures carried out by the control unit 30 for forming toner images.

The procedures are started when the control unit 30 takes in image data. The image data may be sent from the scanner or may be read out from a storage (not shown).

The control unit 30 selects a screen ruling in accordance with image data sent thereto (step S1). In this embodiment, when the image data are character data, the control unit 30 selects 210 lpi as the screen ruling. When the image data are photo data, the control unit selects 190 lpi as the screen ruling.

Next, the control unit 30 judges whether the selected screen ruling is equal to or higher than 200 lpi (step S2). That is, at step S2, the control unit 30 judges whether the selected screen ruling is relatively high (210 lpi) or relatively low (190 lpi). When the screen ruling is equal to or higher than 200 lpi, the processing goes to step S3. When the screen ruling is lower than 200 lpi, the processing goes to step S4.

When the selected screen ruling is equal to or higher than 200 lpi, the control unit 30 recognizes that 210 lpi has been selected as the screen ruling, and the control unit 30 selects 5 kHz as the frequency of the AC developing bias voltage (step S3). Thereafter, the processing goes to step S5.

When the selected screen ruling is lower than 200 lpi, the control unit 30 recognizes that 190 lpi has been selected as the screen ruling, and the control unit 30 selects 9 kHz as the frequency of the AC developing bias voltage (step S4). Thereafter, the processing goes to step S5.

At step S5, the control unit 30 makes the printing section 2 form toner images (step S5). The toner image formation is carried out according to a conventional procedure, and a description of the procedure is omitted.

When the toner image formation is finished, the control unit 30 stops the voltage applying device 32 from outputting the developing bias (step S6). In this way, the toner image forming procedures are completed.

Advantages

The image forming apparatus 1 of the structure above can form high-quality images, regardless of changes in the screen ruling. As shown in Table 1 above, it is preferred, in view of graininess, that the frequency of the AC developing bias voltage is set relatively high when the screen ruling is relatively low (190 lpi). Also, as shown in Table 2 above, it is preferred, in view of density difference, that the frequency of the AC developing bias voltage is set relatively low when the screen ruling is relatively high (210 lpi).

Therefore, the control unit 30 selects a relatively high frequency (9 kHz) as the frequency of the AC developing bias voltage when selecting a relatively low screen ruling (190 lpi) and selects a relatively low frequency (5 kHz) as the frequency of the AC developing bias voltage when selecting a relatively high screen ruling (210 lpi). Thereby, in the image forming apparatus 1, both the graininess and the density difference can be controlled. Consequently, the image forming apparatus 1 can form high-quality images, regardless of changes in the screen ruling.

In the image forming apparatus 1 according to this embodiment, the control unit 30 selects a proper one from two kinds of screen ruling in accordance with image data. However, the control unit 30 may be configured to select a proper one from three or more kinds of screen ruling in accordance with image data. In this case, as the control unit 30 selects a higher screen ruling, the control unit 30 selects a lower frequency as the frequency of the AC developing bias voltage. A modified image forming apparatus 1 will be described below.

Modification

In a modified image forming apparatus 1, the control unit 30 selects one from three kinds of screen ruling, namely, 210 lpi, 200 lpi and 190 lpi. Table 3 shows the relationship among the frequency of the AC developing bias voltage, the screen ruling and the graininess. Table 4 shows the relationship among the frequency of the AC developing bias voltage, the screen ruling and the density difference.

TABLE 3

| | 5 kHz | 7 kHZ | 9 kHz |
|---|---|---|---|
| 210lpi | Unevenness Not Observed | Unevenness Not Observed | Unevenness Not Observed |
| 200lpi | Unevenness Observed | Unevenness Not Observed | Unevenness Not Observed |
| 190lpi | Unevenness Observed | Unevenness Observed | Unevenness Not Observed |

TABLE 4

| | 5 kHz | 7 kHZ | 9 kHz |
|---|---|---|---|
| 210lpi | Density Difference Not Observed | Density Difference Observed | Density Difference Observed |
| 200lpi | Density Difference Not Observed | Density Difference Not Observed | Density Difference Observed |
| 190lpi | Density Difference Not Observed | Density Difference Not Observed | Density Difference Not Observed |

As is shown in Table 3, when the screen ruling is 200 lpi and when the frequency of the AC developing bias voltage is set to a value within a range of 7 kHz to 9 kHz, unevenness is not observed, and the graininess is kept sufficiently low. As shown in Table 4, when the screen ruling is 200 lpi and when the frequency of the AC developing bias voltage is set to a value within a range of 5 kHz to 7 kHz, a density difference is not observed.

Therefore, the control unit 30 selects 9 kHz as the frequency of the AC developing bias voltage when selecting 190 lpi as the screen ruling, selects 7 kHz as the frequency of the AC developing bias voltage when selecting 200 lpi as the screen ruling, and selects 5 kHz as the frequency of the AC developing bias voltage when selecting 210 lpi as the screen ruling.

Figure 4:
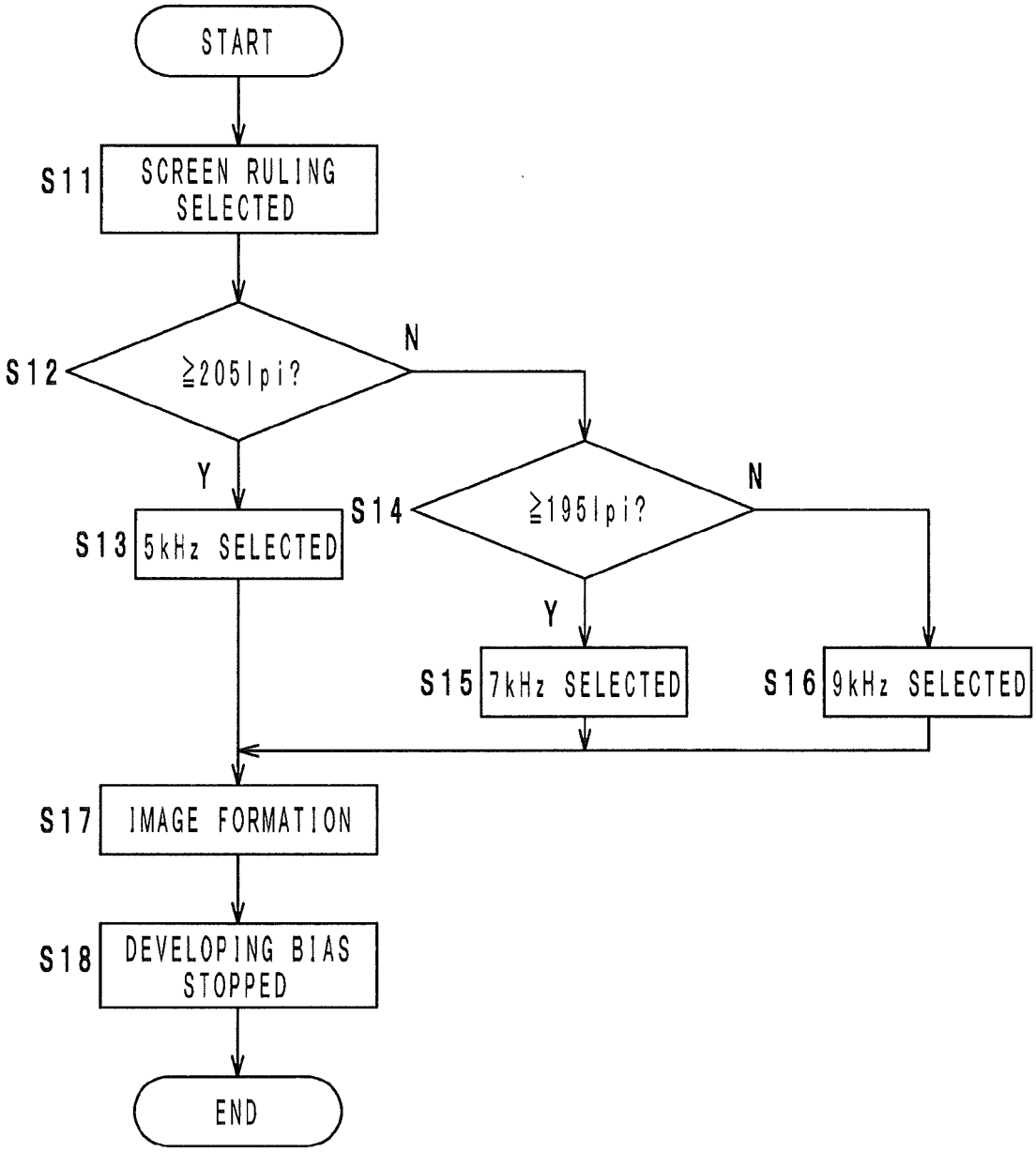
FIG. 4 is a flowchart showing procedures carried out by a control unit of a modified image forming apparatus for forming a toner image.
Figure 5:
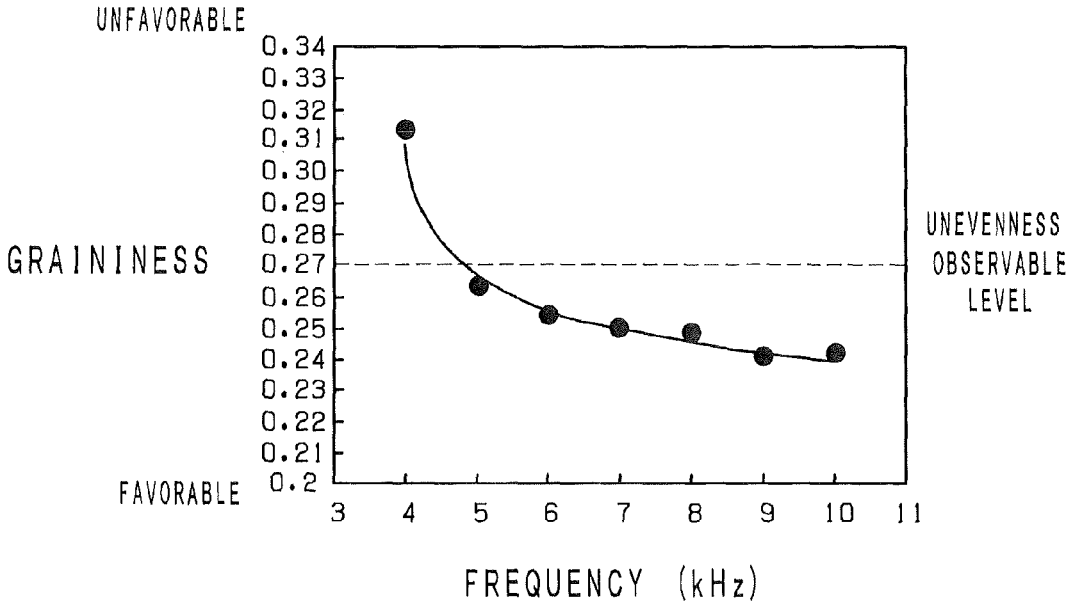
FIG. 5 is a graph showing the relationship between the frequency of an AC developing bias voltage and the graininess.
Figure 6:
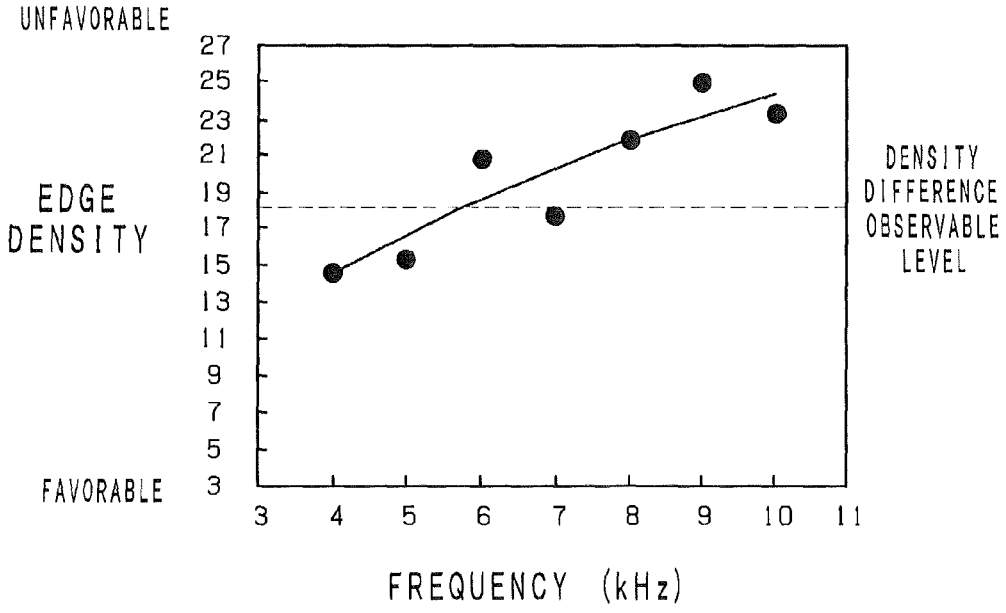
FIG. 6 is a graph showing the relationship between the frequency of an AC developing bias voltage and the edge density.

The operation of the modified image forming apparatus 1 will be described below. FIG. 4 is a flowchart showing procedures carried out by the control unit 30 of the modified image forming apparatus 1 for forming toner images.

The procedures are started when the control unit takes in image data. The image data may be sent from the scanner or may be read out from a storage (not shown).

The control unit 30 selects 210 lpi, 200 lpi or 190 lpi as the screen ruling in accordance with image data inputted thereto (step S11).

Next, the control unit 30 judges whether the selected screen ruling is equal to or higher than 205 lpi (step S12). When the selected screen ruling is equal to or higher than 205 lpi, the processing goes to step S13. When the selected screen ruling is lower than 205 lpi, the processing goes to step S14.

When the selected screen ruling is equal to or higher than 205 lpi, the control unit 30 recognizes that 210 lpi has been selected as the screen ruling, and the control unit 30 selects 5 kHz as the frequency of the AC developing bias voltage (step S13). Thereafter, the processing goes to step S17.

When the selected screen ruling is lower than 205 lpi, the control unit 30 judges whether the selected screen ruling is equal to or higher than 195 lpi (step S14). When the selected screen ruling is equal to or higher than 195 lpi, the processing goes to step S15. When the selected screen ruling is lower than 195 lpi, the processing goes to step S16.

When the selected screen ruling is equal to or higher than 195 lpi, the control unit 30 recognizes that 200 lpi has been selected as the screen ruling, and the control unit 30 selects 7 kHz as the frequency of the AC developing bias voltage (step S15). Thereafter, the processing goes to step S17.

When the selected screen ruling is lower than 195 lpi, the control unit 30 recognizes that 190 lpi has been selected as the screen ruling, and the control unit 30 selects 9 kHz as the frequency of the AC developing bias voltage (step S16). Thereafter, the processing goes to step S17.

At step S17, the control unit 30 makes the printing section 2 form toner images. The toner image formation is carried out according to a conventional procedure, and a description of the procedure is omitted.

When the toner image formation is finished, the control unit 30 stops the voltage applying device 32 from outputting the developing bias (step S18). In this way, the toner image forming procedures are completed.

Like the image forming apparatus 1, the modified image forming apparatus 1 can form high-quality images, regardless of changes in the screen ruling.

Although the present invention has been described in connection with the preferred embodiment above, it is to be noted that various changes and modifications are possible for those who are skilled in the art. Such changes and modifications are to be understood as being within the scope of the present invention.

What is claimed is:

1. An image forming apparatus comprising:

a latent image support member;

a latent image forming unit for forming an electrostatic latent image on the latent image support member in accordance with image data;

a developer support member for supporting a developer including toner and for supplying the toner to the latent image support member to develop the electrostatic latent image;

a voltage applying device for applying a developing bias, which is a superimposed voltage of a DC voltage and an AC voltage, to the developer support member;

a first selecting device for selecting a screen ruling in accordance with the image data; and a second selecting device for selecting a frequency of the AC voltage, wherein the second selecting device selects a first frequency when the first selecting device selects a first screen ruling, and selects a second frequency lower than the first frequency when the first selecting device selects a second screen ruling higher than the first screen ruling.

2. The image forming apparatus according to claim 1, wherein as the first selecting device selects a higher screen ruling, the second selecting device selects a lower frequency.

3. A method for forming an image, comprising the steps of:

forming an electrostatic latent image on a latent image support member in accordance with image data;

supplying toner from a developer support member to the latent image support member to develop the electrostatic latent image;

applying a developing bias, which is a superimposed voltage of a DC voltage and an AC voltage, to the developer support member;

selecting a screen ruling in accordance with the image data; and selecting a frequency of the AC voltage, wherein a first frequency is selected when a first screen ruling is selected, and a second frequency lower than the first frequency is selected when a second screen ruling higher than the first screen ruling is selected.

4. The method according to claim 3, wherein as a higher screen ruling is selected, a lower frequency is selected.

* * * * *